US007908797B2

(12) United States Patent
Graves

(10) Patent No.: US 7,908,797 B2
(45) Date of Patent: Mar. 22, 2011

(54) GUTTER COVER

(75) Inventor: Robert Graves, Toronto (CA)

(73) Assignee: Janice Graves, East Caledon, Ontario (CA)

( * ) Notice: Subject to any disclaimer, the term of this patent is extended or adjusted under 35 U.S.C. 154(b) by 334 days.

(21) Appl. No.: 11/706,419

(22) Filed: Feb. 15, 2007

(65) Prior Publication Data

US 2008/0190040 A1 Aug. 14, 2008

(51) Int. Cl.
*E04D 13/076* (2006.01)

(52) U.S. Cl. ..... 52/12

(58) Field of Classification Search ..... 52/11, 12; 210/474, 155; 248/48.1; D23/267
See application file for complete search history.

(56) References Cited

U.S. PATENT DOCUMENTS

| | | | | |
|---|---|---|---|---|
| 2,271,081 | A | 1/1942 | Layton | |
| 2,423,923 | A * | 7/1947 | Audino | 210/474 |
| 3,436,878 | A | 4/1969 | Singer | |
| 4,937,986 | A * | 7/1990 | Way et al. | 52/12 |
| 5,216,852 | A | 6/1993 | Bemis et al. | |
| 5,271,191 | A | 12/1993 | Vahamaki | |
| 5,398,464 | A | 3/1995 | Jacobs | |
| 5,438,803 | A | 8/1995 | Blizard | |
| 5,842,311 | A | 12/1998 | Morin | |
| 6,016,631 | A | 1/2000 | Lowrie, III | |
| D460,197 | S | 7/2002 | Stringer | |
| 6,826,872 | B2 | 12/2004 | Brochu | |
| 6,904,718 | B2 | 6/2005 | Fox | |
| 6,968,651 | B2 | 11/2005 | Bergeron | |
| 7,056,433 | B2 | 6/2006 | Swistun | |
| 7,143,549 | B2 * | 12/2006 | Brochu | 52/12 |
| 2002/0166290 | A1 | 11/2002 | Bergeron | |
| 2003/0110712 | A1 | 6/2003 | Brochu | |
| 2004/0118052 | A1 | 6/2004 | Brochu | |
| 2004/0187336 | A1 * | 9/2004 | Lee | 33/761 |
| 2004/0244303 | A1 * | 12/2004 | Seise, Jr. | 52/12 |
| 2005/0028452 | A1 | 2/2005 | Brochu | |
| 2005/0155919 | A1 | 7/2005 | Swistun | |
| 2005/0210758 | A1 * | 9/2005 | Iannelli | 52/11 |
| 2006/0037254 | A1 | 2/2006 | Brochu | |
| 2006/0037255 | A1 | 2/2006 | Brochu | |
| 2006/0123710 | A1 | 6/2006 | Lenney et al. | |
| 2006/0163129 | A1 | 7/2006 | Swistun | |
| 2006/0201068 | A1 | 9/2006 | Shane | |
| 2006/0230687 | A1 * | 10/2006 | Ealer, Sr. | 52/12 |
| 2007/0199249 | A1 * | 8/2007 | Beck et al. | 52/12 |
| 2008/0127575 | A1 * | 6/2008 | Ealer | 52/12 |
| 2009/0031638 | A1 * | 2/2009 | Iannelli | 52/12 |

* cited by examiner

*Primary Examiner* — Robert J Canfield
*Assistant Examiner* — Christine T Cajilig
(74) *Attorney, Agent, or Firm* — Riches, McKenzie & Herbert LLP

(57) ABSTRACT

A gutter cover comprising a sheet having a front portion, a rear portion, and a central portion extending between said front portion and said rear portion; said central portion having a plurality of openings for passage of water therethrough, said front portion comprising an upper wall segment, a bend segment, and a lower wall segment, wherein said upper wall segment extends forwardly from said central portion to said bend segment, said bend segment joins said upper wall segment and said lower wall segment, and said lower wall segment extends rearwardly from said bend segment and underneath said upper wall segment, wherein a space is formed between said upper wall segment and said lower wall segment, wherein a first fastener extends through openings in said upper wall segment and said lower wall segment, and wherein a distance between an upper surface of said upper wall segment and an upper surface of said lower wall segment is greater than or equal to an axial height of a head portion of said first fastener.

18 Claims, 5 Drawing Sheets

GUTTER COVER

SCOPE OF THE INVENTION

The present invention relates to a device for protecting a gutter, and in particular, to a gutter cover which prevents debris from entering into a gutter, while allowing water to enter in.

BACKGROUND OF THE INVENTION

Gutter covers are known devices that are positioned over top of the open troughs of gutters. Such gutter covers are designed to prevent debris, such as leaves, from entering into the trough of the gutter, while allowing water, such as rain water and melted ice and snow, to enter in. Debris resting on the gutter cover can be blown off by the wind.

Examples of gutter covers are shown in U.S. Pat. No. 6,968,651 to Bergeron and U.S. Patent Application Publication No. 2006/0201068 to Shane. The present inventor has appreciated that these gutter covers have a disadvantage in that the head of the screw which fastens the gutter cover to front lip of the gutter protrudes above the upper surface of the gutter cover. As a result, debris tends to get caught on the head of the screw.

SUMMARY OF THE INVENTION

To at least partially overcome the disadvantages of previously known gutter covers, the present invention provides an improved gutter cover.

An object of the present invention is to provide an improved gutter cover which can be securely attached to the front lip of a gutter by a fastener, where the front portion is designed such that the fastener does not protrude above the upper surface of the gutter cover and therefore, debris does not get caught on the fastener.

Another object of the present invention is to provide a gutter cover which is attached securely against the fascia so as to prevent the gutter cover from collapsing into the trough of the gutter under the weight of ice and snow, and to prevent animals, such as squirrels and racoons, from pulling the gutter cover off.

A further object of the present invention is to provide a gutter cover having a rear portion which is held tightly against the fascia such that no fastener is required to secure the rear portion to the fascia.

A further object of the present invention is to provide a gutter cover having a central portion which has a structure for directing water into openings in the gutter cover.

In one aspect, the present invention provides a gutter cover comprising a sheet having a front portion, a rear portion, and a central portion extending between said front portion and said rear portion; said central portion having a plurality of openings for passage of water therethrough, said front portion comprising an upper wall segment, a bend segment, and a lower wall segment, wherein said upper wall segment extends forwardly from said central portion to said bend segment, said bend segment joins said upper wall segment and said lower wall segment, and said lower wall segment extends rearwardly from said bend segment and underneath said upper wall segment, wherein a space is formed between said upper wall segment and said lower wall segment, wherein a first fastener extends through openings in said upper wall segment and said lower wall segment, and wherein a distance between an upper surface of said upper wall segment and an upper surface of said lower wall segment is greater than or equal to an axial height of a head portion of said first fastener.

In another aspect, the present invention provides a gutter system for placement on a fascia at a roof edge, said gutter system comprising: (a) a gutter; and (b) a gutter cover, wherein said gutter comprises a front wall, a rear wall, and a bottom wall extending between said front wall and said rear wall, wherein said front wall, bottom wall and rear wall define a trough having an open top therebetween, wherein said gutter further comprises a gutter lip extending from an upper edge of said front wall, said gutter cover comprising a sheet having a front portion, a rear portion, and a central portion extending between said front portion and said rear portion; said central portion having a plurality of openings for passage of water therethrough, said front portion comprising an upper wall segment, a bend segment, and a lower wall segment, wherein said upper wall segment extends forwardly from said central portion to said bend segment, said bend segment joins said upper wall segment and said lower wall segment, and said lower wall segment extends rearwardly from said bend segment and underneath said upper wall segment, wherein a space is formed between said upper wall segment and said lower wall segment, wherein a lower surface of said lower wall segment abuts against an upper surface of said gutter lip, wherein a first fastener extends through openings in said upper wall segment and said lower wall segment and through said gutter lip, and wherein a distance between an upper surface of said upper wall segment and an upper surface of said lower wall segment is greater than or equal to an axial height of a head portion of said first fastener.

In a preferred embodiment, the upper wall segment of the front portion forms an upwardly arching curve, while the lower wall segment of the front portion is planar.

Preferably, a second fastener, such as a screw, nail or bolt, extends through openings in the rear portion of the gutter cover and the fascia.

The rear portion preferably extends rearwardly and upwardly from the central portion so as to abut against the fascia, and forms an S-shape.

In a preferred embodiment, the central portion is substantially planar.

In another preferred embodiment, the central portion comprises a raised section to increase water flowing into the openings. The raised section is preferably a ridge.

The openings in the central portion are preferably arranged in one or more rows.

The gutter cover is preferably made from a metallic material or a plastic material. More preferably, the gutter cover is made from aluminum.

BRIEF DESCRIPTION OF THE DRAWINGS

Further aspects and advantages will become apparent from the following description taken together with the accompanying drawings in which.

Throughout all the drawings in the disclosure, similar parts are indicated by the same reference numerals.

DESCRIPTION OF THE PREFERRED EMBODIMENT

Reference is made to FIGS. 1 to 5 which show preferred embodiments of the present invention.

Figure 1:
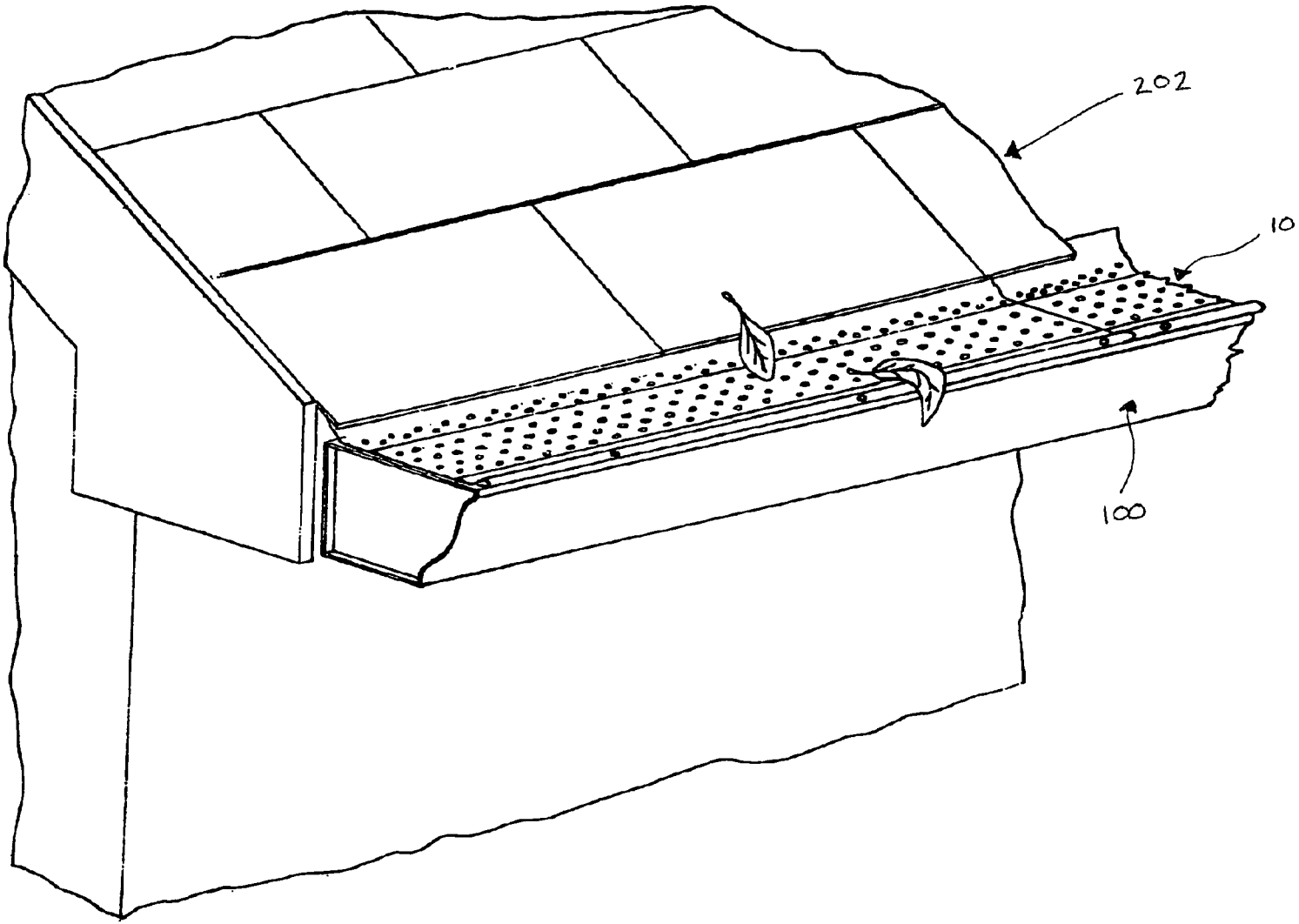
FIG. 1 is a perspective view of a gutter system in accordance with a first preferred embodiment of the present invention, said gutter system comprising: (a) a gutter; and (b) a gutter cover.
Figure 2:
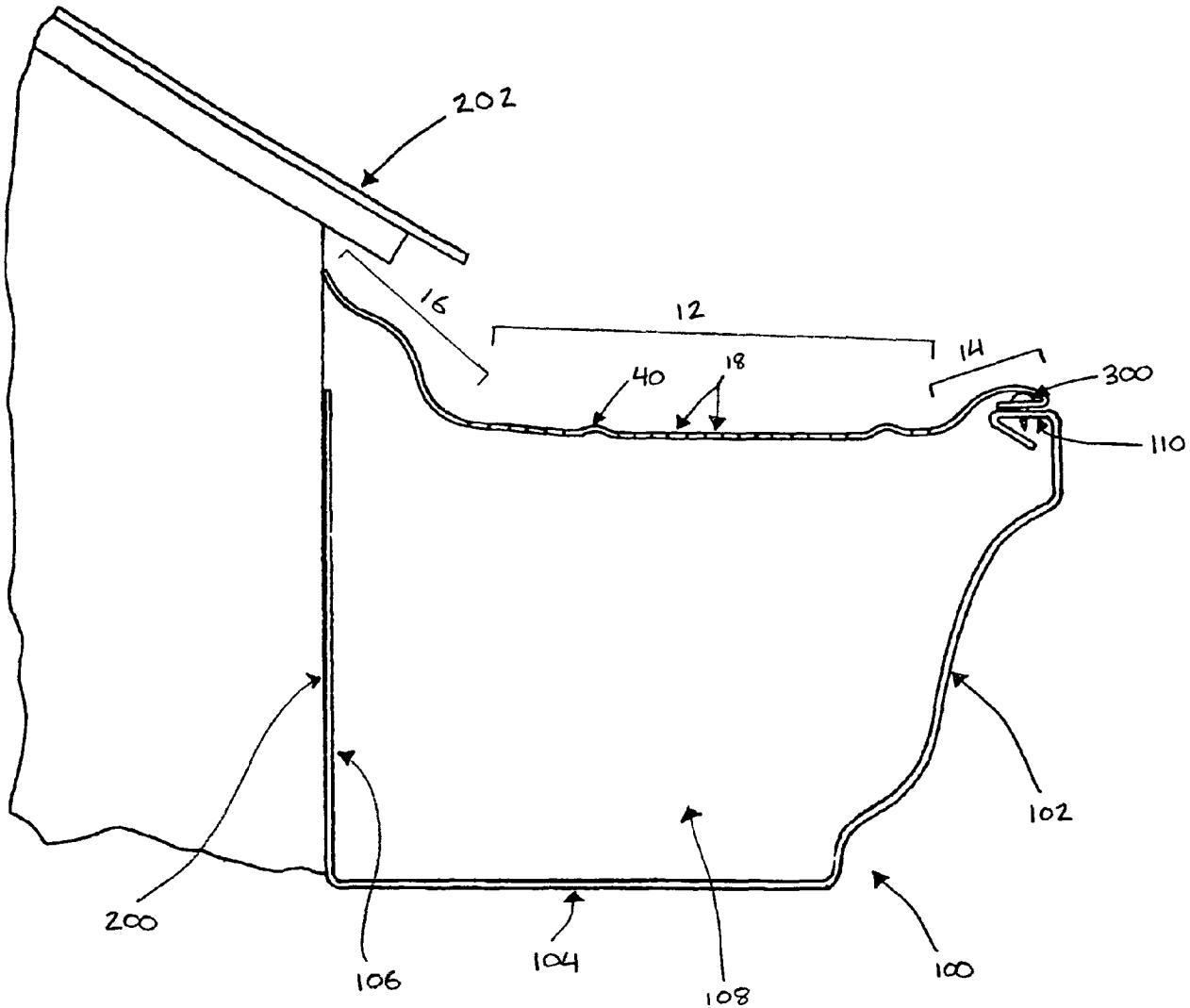
FIG. 2 is a side view of the gutter system shown in FIG. 1.

FIGS. 1 to 4 illustrate a first preferred embodiment of the present invention. As shown in FIGS. 1 and 2, the gutter cover 10 is positioned over a gutter 100. The gutter 100 comprises a front wall 102, a bottom wall 104, and a rear wall 106. The bottom wall 104 extends between and merges with the front wall 102 and the rear wall 106. The front wall 102, bottom wall 104 and rear wall 106 define a trough 108 having an open top therebetween. The gutter 100 is installed on the fascia 200 at a roof edge 202 of a building structure. Water, specifically rain water and melted snow and ice, runs off the roof 202 of the building structure and into the trough 108 of the gutter 100.

Figure 4:
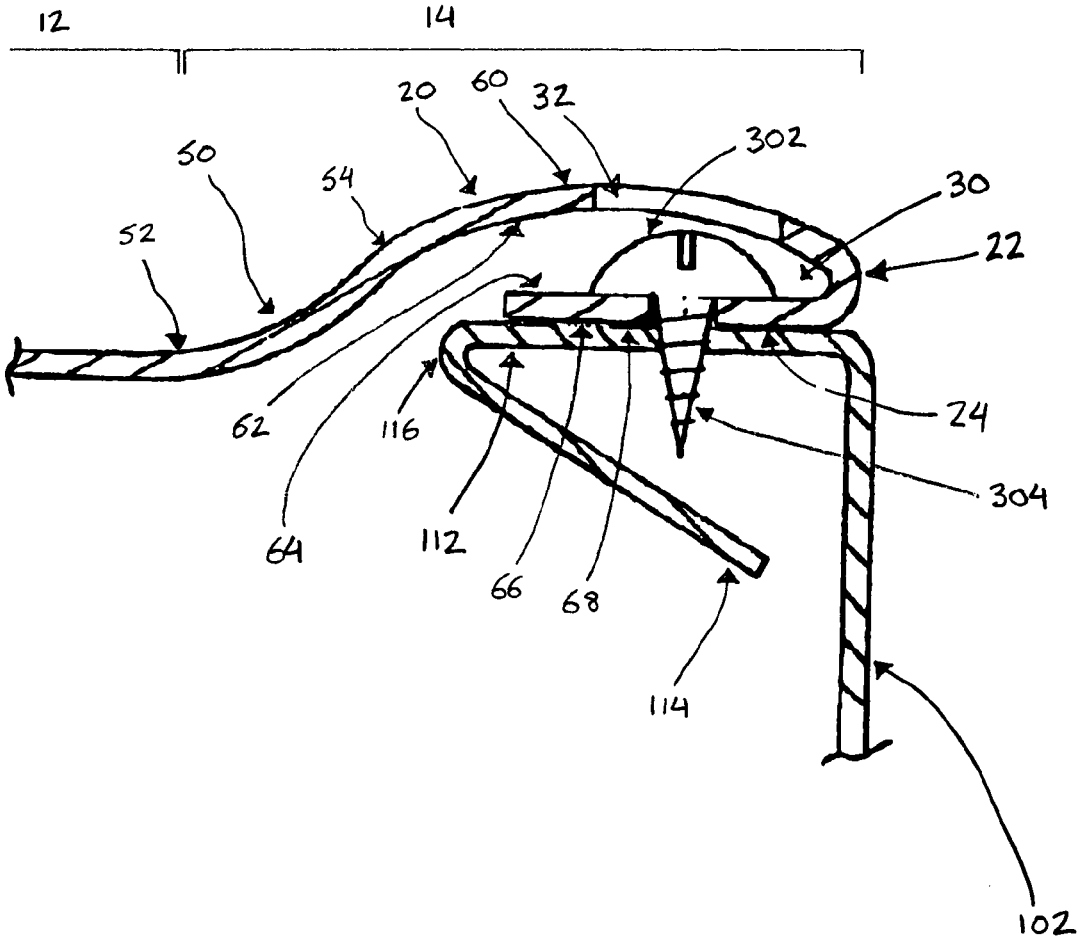
FIG. 4 is an enlarged side view of the front portion of the gutter cover and the gutter lip of the gutter shown in FIG. 1.

The gutter 100 also has a gutter lip 110 which merges with and extends from an upper edge of the front wall 102. In the first preferred embodiment, as illustrated in FIG. 4, the gutter lip 110 comprises a first segment 112 and a second segment 114. The first segment 112 extends from the front wall 102 in a generally horizontal and rearward direction. The gutter lip 110 is bent back at 116, and the second segment 114 extends downwardly and forwardly towards the front wall 102.

Figure 3:
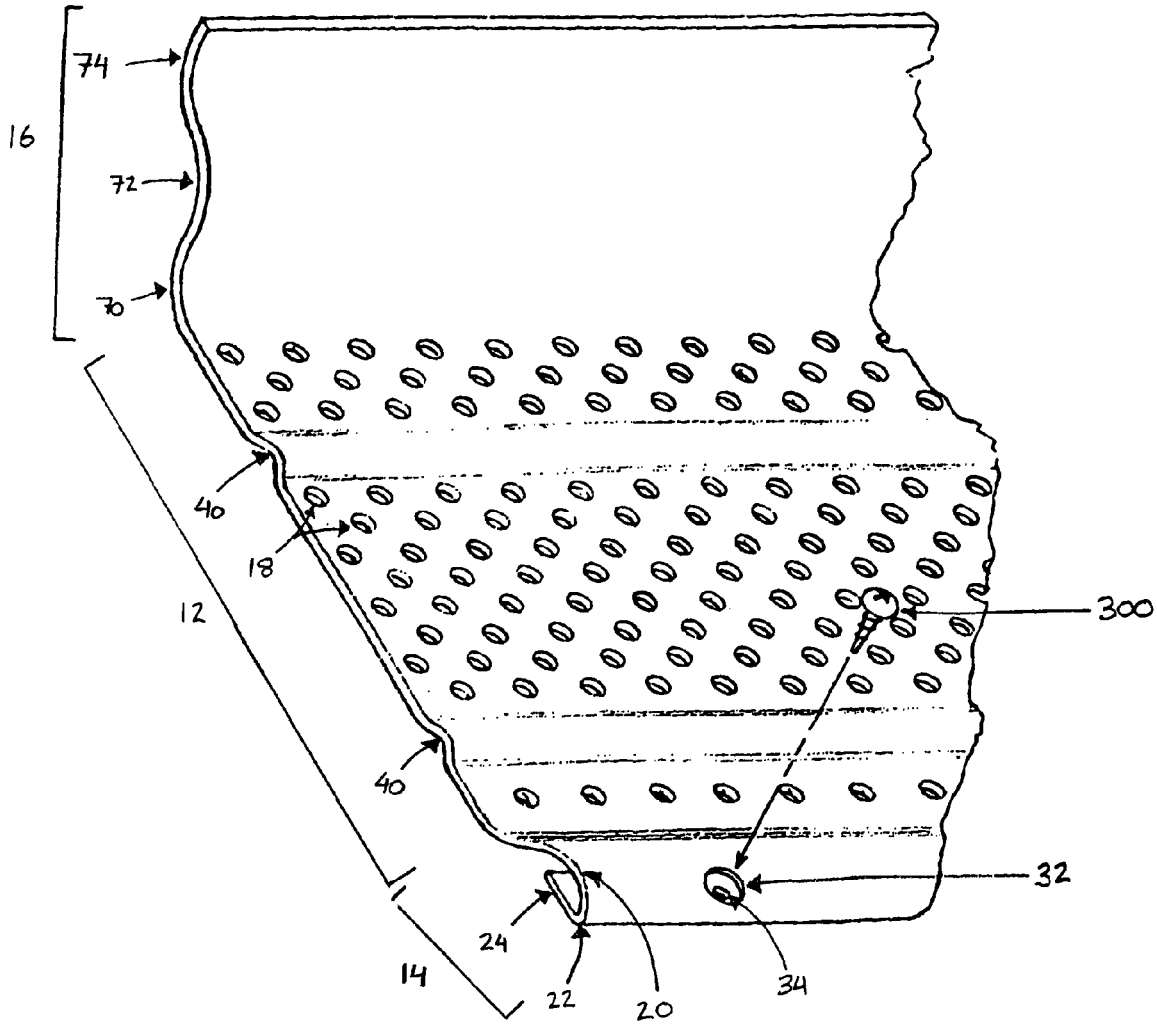
FIG. 3 is a partial perspective view of the gutter cover shown in FIG. 1.

As illustrated in FIGS. 2 and 3, the gutter cover 10 has: (i) a central portion 12; (ii) a front portion 14; and (iii) a rear portion 16. The front portion 14 merges with and extends forwardly from the central portion 12. The rear portion 16 merges with and extends rearwardly from the central portion 12. The gutter cover 10 is made from a sheet of aluminium metal.

In FIG. 3, the central portion 12 of the gutter cover 10 has a plurality of openings 18 extending therethrough. The openings 18 are of a size so as to prevent debris, such as leaves, from passing through the gutter cover 10 and entering into the trough 108 of the gutter 100, while allowing water to pass through and enter in. Debris cannot pass through the openings 18, and will rest on the upper surface of the gutter cover 10. Eventually, the wind will blow the debris off of the gutter cover 10 and away from the building. The openings 18 are arranged in rows and are circular in shape.

The central portion 12 of the gutter cover 10 has a pair of raised ridges 40. The ridges 40 are parallel to each other and extend laterally along the central portion 12. The ridges 40 assist in directing water to flow to the openings 18.

As shown in FIG. 4, the front portion 14 has a first segment 50, an upper wall segment 20, a bend segment 22, and a lower wall segment 24. At 52, the first segment 50 merges with the central portion 12 and extends upwardly and forwardly. The first segment 50 extends upwardly and forwardly to form a concave curve. At 54, the upper wall segment 20 merges with the first segment 50, and extends forwardly to form an upwardly arching convex curve, as can be seen in FIG. 4.

The bend segment 22 is a bight-shaped segment joining the upper wall segment 20 and the lower wall segment 24. The lower wall segment 24 merges with and extends rearwardly from the bend segment 22 and is planar. As illustrated in FIG. 4, the lower wall segment 24 extends underneath the upper wall segment 20.

A space 30 is formed between the lower surface 62 of the upper wall segment 20 and the upper surface 64 of the lower wall segment 24. The upper wall segment 20 has large opening 32, while the lower wall segment 24 has a corresponding small opening 34 which is located directly below the large opening 32. The large opening 32 in the upper wall segment 20 and the small opening 34 in the lower wall segment 24 are co-axially aligned with each other.

The central portion 12 merges into the rear portion 16 which extends rearwardly from the central portion 12. The rear portion 16 extends rearwardly and upwardly from the central portion 12 in an S-shape, as shown in FIGS. 2 and 3. The rear portion 16 comprises: (i) a first concave segment 70 extending from the central portion 12; (ii) a second convex segment 72 extending from the first concave segment 70; and (iii) a third concave segment 74 extending from the second convex segment 72, thus forming an S-shape.

When the gutter cover 10 is positioned over the gutter 100, the rear portion 16 extends rearwardly and upwardly so as to abut against the fascia 200. The S-shape of the rear portion 16 causes the third concave segment 74 of the rear portion 16 to push against the fascia 200 in a spring like action. The rear portion 16 of the gutter cover 10 is therefore held tightly against the fascia 200, without requiring a fastener to secure the rear portion 16 to the fascia 200.

As shown in FIGS. 1 and 2, the gutter cover 10 is positioned over top of the gutter 100 and covers the trough 108. As illustrated in FIG. 4, the lower surface 66 of the lower wall segment 24 abuts against the upper surface 68 of the gutter lip 110. A first screw 300 is a self-tapping screw which is installed to secure the gutter cover 10 to the gutter 100. When being installed, the shaft 304 of the self-tapping first screw 300 is positioned into the large opening 32 in the upper wall segment 20 and the small opening 34 in the lower wall segment 24. The self-tapping first screw 300 is then driven through the gutter lip 110, thus securing the front portion 14 of the gutter cover 10 to the gutter lip 110.

The large opening 32 in the upper wall segment 24 is large enough so as to allow the entire first screw 300, including the head 302, to pass therethrough. The small opening 34 in the lower wall segment 24 is of a size so as to allow the shaft 304 of the first screw 300 to pass through, but not allow the head 302 of the first screw 300 to pass through. When the self-tapping first screw 300 is installed, the head 302 of the first screw 300 does not rise above the upper surface 60 of the upper wall segment 20. In the preferred embodiment of FIGS. 1 to 4, the head 302 of the first screw 300 is located within the space 30 between the upper wall segment 20 and the lower wall segment 24.

Advantageously, when debris is blown off of the surface of the gutter cover 10, the head 302 of the screw 300 does not catch any of the debris, thus allowing such debris to be easily blown off and away from the building.

Also, the use of the first screw 300 holds the gutter cover 10 securely to the gutter 100, which is of assistance in preventing the gutter cover 10 from collapsing into the trough 108 under the weight of debris, ice and snow, and preventing animals, such as squirrels and racoons, from pulling the gutter cover 10 off of the gutter 100.

Figure 5:
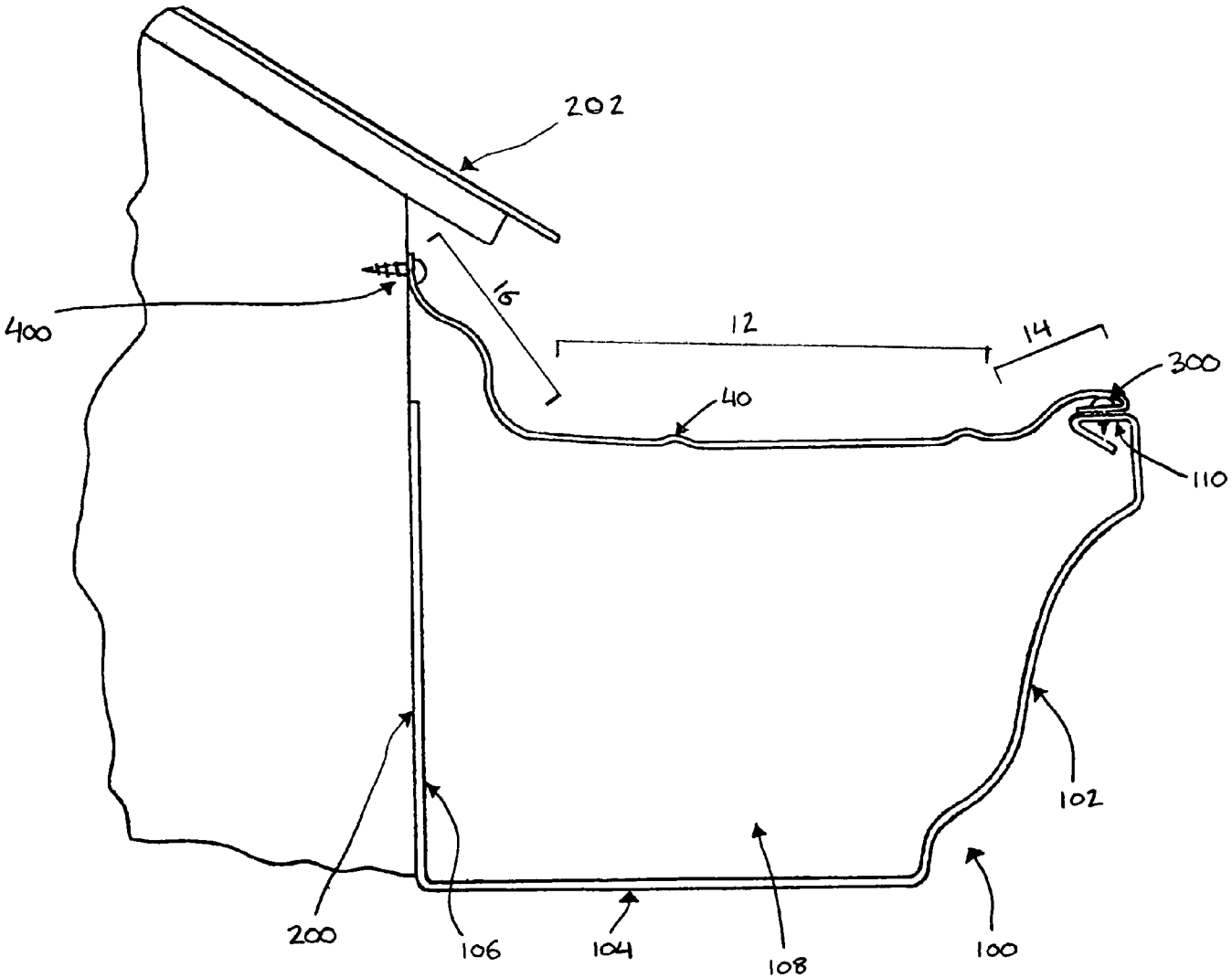
FIG. 5 is a side view of a gutter system in accordance with a second preferred embodiment of the present invention.

FIG. 5 illustrates a second preferred embodiment of the present invention. In the second preferred embodiment, the rear portion 16 has an opening therethrough for receiving a screw. A second screw 400 passes through the opening in the rear portion 16 and into the fascia 200, thus further assisting in securing the gutter cover 10. When installed, the second screw 400 holds a portion of the third concave segment 74 flat against the fascia 200.

In an alternative embodiment, nails or bolts are used to secure the front portion of the gutter cover to the gutter lip and to secure the rear portion of the gutter cover to the fascia.

The gutter cover can be made from a metallic material or a plastic material.

The openings in the central portion of the gutter cover can be arranged in any formation, and can be of any shape.

Although this disclosure has described and illustrated preferred embodiments of the invention, it is to be understood that the invention is not restricted to these particular embodiments. Rather, the invention includes all embodiments that are functional or mechanical equivalents of the specific embodiments in features that have been described and illustrated herein. Many modifications and variations will now occur to those skilled in the art. For a definition of the invention, reference is made to the following claims.

The invention claimed is:

1. A gutter cover comprising a sheet having a front portion, a rear portion, and a central portion extending between said front portion and said rear portion;

said central portion having a plurality of openings for passage of water therethrough, the central portion being substantially planar and having an upwardly directed upper surface, said front portion comprising a first segment, an upper wall segment, a bend segment, and a lower wall segment, wherein said first segment extends forwardly from said central portion to said upper wall segment, said upper wall segment joins said first segment and said bend segment, said bend segment joins said upper wall segment and said lower wall segment, and said lower wall segment extends rearwardly from said bend segment and underneath said upper wall segment, wherein a space is formed between said upper wall segment and said lower wall segment underneath the upper wall segment, the upper wall segment having an upper opening therethrough, the lower wall segment having a lower opening therethrough, the upper opening and the lower opening substantially aligned, the first segment having an upwardly directed upper surface, the upper wall segment having an upwardly directed upper surface, the lower wall segment having an upwardly directed upper surface, a first fastener extends through said upper wall segment via the upper opening and through said lower wall segment via the lower opening, and wherein a distance between the upper surface of said upper wall segment and the upper surface of said lower wall segment is greater than or equal to an axial height of a head portion of said first fastener, the first segment extends upwardly and forwardly from the central portion to provide the upper surface of the first segment as a concave curve which merges smoothly with the upper surface of the central portion and with the upper surface of said upper wall segment, said upper wall segment extends forwardly from the first segment to provide the upper surface of said upper wall segment as a convex curve extending upwardly to the upper opening then downwardly to the bend portion to merge smoothly with an upwardly directed upper surface of the bend portion, said lower wall segment of said front portion is planar, an axis of the first fastener passes through a distal end of the first fastener, the head portion of the first fastener, the upper opening and the lower opening.

2. The gutter cover of claim 1, wherein a second fastener extends through an opening in said rear portion of said gutter cover.

3. The gutter cover of claim 1, wherein said rear portion extends rearwardly and upwardly from said central portion and forms an S-shape.

4. The gutter cover of claim 1, wherein said central portion comprises a raised section to increase water flowing into said openings.

5. The gutter cover of claim 4, wherein said raised section is a ridge.

6. The gutter cover of claim 1, wherein said openings are arranged in one or more rows.

7. The gutter cover of claim 1, wherein said gutter cover comprises a metallic material.

8. The gutter cover of claim 1, wherein said first fastener is a screw.

9. A gutter system for placement on a fascia at a roof edge, said gutter system comprising: (a) a gutter; and (b) a gutter cover, wherein said gutter comprises a front wall, a rear wall, and a bottom wall extending between said front wall and said rear wall, wherein said front wall, bottom wall and rear wall define a trough having an open top therebetween, wherein said gutter further comprises a gutter lip extending from an upper edge of said front wall, said gutter cover comprising a sheet having a front portion, a rear portion, and a central portion extending between said front portion and said rear portion;

said central portion having a plurality of openings for passage of water therethrough, the central portion being substantially planar and having an upwardly directed upper surface, said front portion comprising a first segment, an upper wall segment, a bend segment, and a lower wall segment, wherein said first segment extends forwardly from said central portion to said upper wall segment, said upper wall segment joins said first segment and said bend segment, said bend segment joins said upper wall segment and said lower wall segment, and said lower wall segment extends rearwardly from said bend segment and underneath said upper wall segment, wherein a space is formed between said upper wall segment and said lower wall segment underneath the upper wall segment, the upper wall segment having an upper opening therethrough, the lower wall segment having a lower opening therethrough, the upper opening and the lower opening substantially aligned, the first segment having an upwardly directed upper surface, the upper wall segment having an upwardly directed upper surface, the lower wall segment having an upwardly directed upper surface, a lower surface of said lower wall segment abuts against an upper surface of said gutter lip, wherein a first fastener extends through said upper wall segment via the upper opening and through said lower wall segment via the lower opening and through said gutter lip, and wherein a distance between the upper surface of said upper wall segment and the upper surface of said lower wall segment is greater than or equal to an axial height of a head portion of said first fastener, the first segment extends upwardly and forwardly from the central portion to provide the upper surface of the first segment as a concave curve which merges smoothly with the upper surface of the central portion and with the upper surface of said upper wall segment, said upper wall segment extends forwardly from the first segment to provide the upper surface of said upper wall segment as a convex curve extending upwardly to the upper opening then downwardly to the bend portion to merge smoothly with an upwardly directed upper surface of the bend portion, and said lower wall segment of said front portion is planar, an axis of the first fastener passes through a distal end of the first fastener, the head portion of the first fastener, the upper opening and the lower opening, wherein the gutter cover secured to the gutter with the first fastener securing the lower wall segment of said front portion to the gutter lip with the central portion being substantially horizontal.

10. The gutter system of claim 9, wherein a second fastener extends through openings in said rear portion of said gutter cover and said fascia.

11. The gutter system of claim 9, wherein said rear portion extends rearwardly and upwardly from said central portion so as to abut against said fascia, and wherein said rear portion forms an S-shape.

12. The gutter system of claim 9, wherein said central portion comprises a raised section to increase water flowing into said openings.

13. The gutter system of claim 12, wherein said raised section is a ridge.

14. The gutter system of claim 9, wherein said openings are arranged in one or more rows.

15. The gutter system of claim 9, wherein said gutter cover comprises a metallic material.

16. The gutter system of claim 9, wherein said first fastener is a screw.

17. The gutter system of claim 9, wherein said central portion has an upper surface which is substantially planar and disposed horizontal, however, the central portion includes a pair of narrow ridges rising above the planar upper surface of the central portion, each of the ridges extending parallel to the front portion with a forwardmost of the pair of ridges spaced rearwardly from the front portion proximate to the front portion and a rearmost of the pair of ridges spaced rearwardly from the rear portion proximate to the rear portion.

18. The gutter system of claim 17, wherein said rear portion extends rearwardly and upwardly from said central portion so as to abut against said fascia.

* * * * *